United States Patent [19]

Conway

[11] 4,389,959

[45] Jun. 28, 1983

[54] CARGO HANDLING SYSTEM FOR TANKER VESSELS

[76] Inventor: Charles S. Conway, Featherbed La., New Vernon, N.J. 07976

[21] Appl. No.: 180,046

[22] Filed: Aug. 21, 1980

Related U.S. Application Data

[63] Continuation-in-part of Ser. No. 913,956, Jun. 9, 1978, Pat. No. 4,241,683, which is a continuation-in-part of Ser. No. 809,395, Jun. 23, 1977, abandoned.

[51] Int. Cl.[3] ..... B63B 25/12

[52] U.S. Cl. ..... 114/74 R; 114/125

[58] Field of Search ..... 114/73, 74 R, 74 T, 114/75, 124, 125, 256

[56] References Cited

U.S. PATENT DOCUMENTS

| | | | |
|---|---|---|---|
| 2,314,555 | 3/1943 | Preuss | 114/74 R |
| 3,307,512 | 3/1967 | Fell | 114/74 R |
| 3,785,321 | 1/1974 | Backstrom | 114/74 R |
| 3,859,444 | 1/1975 | Warner | 114/74 R |
| 3,868,921 | 3/1975 | Seymour | 114/74 R |
| 3,926,135 | 12/1975 | De Gregorio | 114/74 R |

FOREIGN PATENT DOCUMENTS

| | | |
|---|---|---|
| 981026 | 1/1925 | United Kingdom . |
| 981026 | 1/1965 | United Kingdom . |
| 1373009 | 11/1974 | United Kingdom . |

*Primary Examiner*—Trygve M. Blix
*Assistant Examiner*—Thomas J. Brahan
*Attorney, Agent, or Firm*—Kenyon & Kenyon

[57] ABSTRACT

An improved tanker vessel for carrying a plurality of liquid cargoes each having a specific gravity which is less than that of sea water. The vessel includes a hull comprising a bottom and sides, a top deck, at least one cargo compartment disposed between the top deck and the hull bottom for storing the liquid cargo, and a main liquid cargo charging and discharging system coupled to the cargo compartment for charging and discharging the compartment. The improvement comprises an additional liquid cargo charging and discharging system coupled to the cargo compartment which includes a longitudinal pipe and transversely disposed branch lines coupled to the longitudinal pipe. The branch lines include a suction opening disposed in and opening into the compartment at a distance above the hull bottom which is approximately equal to $H(S_w/S_c)-0.10H$, where H represents the distance from the bottom of the vessel to its waterline, $S_w$ represents the specific gravity of sea water, and $S_c$ represents the specific gravity of the heaviest liquid cargo which the vessel is adapted to carry.

8 Claims, 4 Drawing Figures

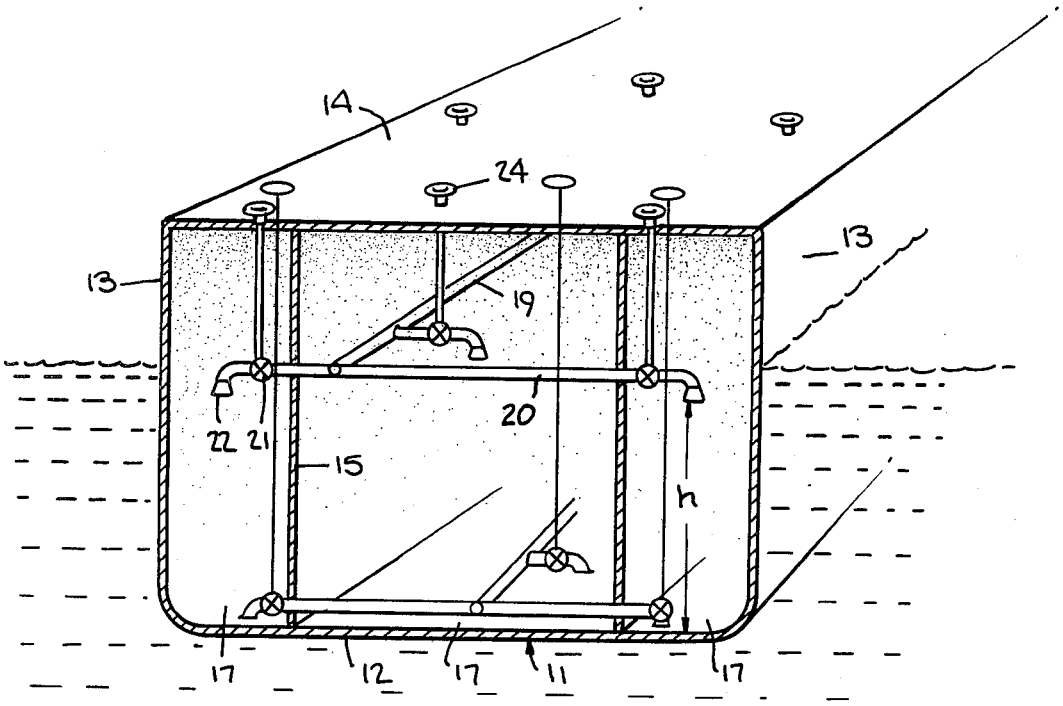
Fig. 3.
Fig. 4.
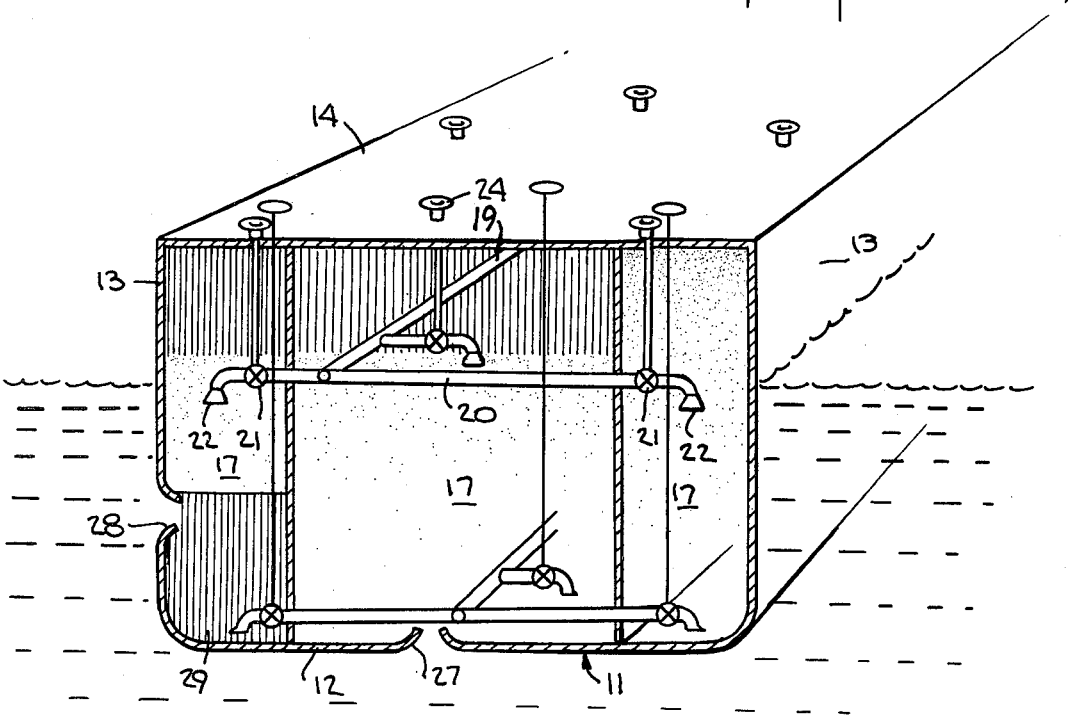

CARGO HANDLING SYSTEM FOR TANKER VESSELS

This application is a continuation-in-part of my earlier copending application, Ser. No. 913,956 filed June 9, 1978, U.S. Pat No. 4,241,683 which in turn is a continuation-in-part of application Ser. No. 809,395 filed June 23, 1977, now abandoned.

BACKGROUND OF THE INVENTION

1. Field of the Invention

The present invention relates generally to tanks in a fluid, and in particular to an improved cargo handling system for a tanker vessel for transporting liquid cargoes.

2. Description of the Prior Art

Tanker vessels for the transportation in bulk of liquid cargo are known in the art. See, for example, U.S. Pat. No. 2,918,032. Such tanker vessels generally comprise a plurality of liquid-tight transverse bulkheads and one or more liquid-tight longitudinal bulkheads which subdivide the tanker vessel into a plurality of liquid-tight storage compartments. If the bottom or a side of the hull of such a tanker vessel is ruptured by grounding or some other accident, the affected cargo tanks will leak until the "pressure head" of the liquid cargo in each tank, i.e., approximately the portion of the liquid cargo disposed above the waterline of the vessel, flows out of the tanker vessel. Following such leakage, it is often a significant problem and also an additional pollution potential, not to be able to remove or transfer cargo.

In recent years, pollution by oil tankers as a result of a hull rupture caused by grounding or other major catastrophe has become of increasing concern. As a result, various anti-pollution tanker constructions have been proposed. For example, it has been proposed to construct a tanker vessel with double sides defining side tanks extending from the top deck of the vessel to the hull bottom which are disposed adjacent to and associated with cargo tanks in the vessel. See U.S. Pat. No. 3,832,966. These side tanks have a volume from the hull bottom to the waterline of the tanker vessel which is equal to the respective volumes of the cargo tanks above the waterline. Valves coupling the side tanks to the cargo tanks are opened if the tanker hull is ruptured to permit oil in the cargo tanks to drain off into the side tanks so that the oil above the waterline in the cargo tanks does not escape from the ruptured hull bottom. Larger vents are used in the side tanks than in the cargo tanks to achieve this drainage from the cargo tanks to the side tanks instead of into the sea. The disadvantage of this design, however, is that the side tanks provided for receiving the "pressure head" of the liquid cargo carried in the cargo tanks is, similar to the space between the inner and outer hull bottoms in a double-bottom tanker, unavailable for the storage and transportation of cargo and, accordingly, increases the fabrication, maintenance and operating costs of the tanker vessel. Moreover, such a design is theoretical only and in practice would save not more than 2 to 3% of the liquid cargo carried by such a tanker vessel.

When emergency situations such as a hull rupture occur during the operation of a tanker vessel, very often there is little time, a minimum of available manpower, and quite often very little or no means in the vessel to aid in eliminating the problem. A tanker vessel's cargo handling system is a prime example of this. While the typical cargo handling system is expedient for normal cargo loading and discharging as well as ballast handling, it becomes virtually useless for handling cargo from those tanks whose bottoms have been ruptured and opened to the sea, since following such an event, there is a rapid loss of the cargo's pressure head and then after several minutes of pumping with the vessel's main cargo handling system, the bottom three to four inches of cargo will normally be displaced with sea water and thereafter only sea water will be pumped by the system.

SUMMARY OF THE INVENTION

It is, therefore, an object of the present invention to provide a redundant emergency cargo handling system for tanker vessels which permits the transfer of cargo after the cargo tanks of such a vessel have been opened to the sea, by below-water casualty, the jettison of cargo, or the discharge of cargo.

It is also an object of the present invention to provide a redundant cargo handling system for tanker vessels which overcomes the aforementioned disadvantages of heretofore known systems and reduces fluid cargo losses and pollution in the case of rupture of the tanker hull.

It is another object of the present invention to provide a redundant cargo handling system for tanker vessels which reduces stability problems occurring as a result of major hull bottom damage to the tanker vessel.

These and other objects of the present invention are achieved in a tanker vessel adapted for carrying a plurality of liquid cargoes each having a specific gravity which is less than that of sea water. The vessel includes a hull comprising a bottom and sides, a top deck and at least one cargo compartment disposed between the top deck and the hull bottom for storing the liquid cargo. The vessel further includes a main liquid cargo charging and discharging means coupled to the cargo compartment for charging and discharging the compartment. The improvement comprises additional liquid cargo charging and discharging means coupled to the cargo compartment which includes pipe means longitudinally disposed in the vessel and transversely disposed valved branch line means coupled to the pipe means, the branch line means including a suction opening disposed in and opening into the cargo compartment at a distance above the hull bottom which is approximately equal to $H(S_w/S_c)-0.10$ H, where H represents the distance from the bottom of the vessel to its waterline, $S_w$ represents the specific gravity of sea water, and $S_c$ represents the specific gravity of the heaviest liquid cargo which the vessel is adapted to carry.

The present invention may reduce leakage through ruptures in the sides and/or the bottom of the hull of the vessel. Moreover, by maintaining a controlled vessel freeboard, the cargo handling system of the invention should enable removal of virtually all of the vessel's remaining cargo from the damaged cargo compartments with little or no need for salvage assistance. Also, in the event a cargo compartment's main cargo handling system becomes inoperable, due to valve or piping breakdowns when the tank's shell is intact, water may be injected into the compartments thus allowing cargo discharging in emergency situations.

Aside from the foregoing, there are numerous other advantages provided by a tanker vessel constructed in accordance with the invention. For example, the safety of the vessel is enhanced compared to other types of ships following major accident or grounding damage in cargo tank areas since the vessel will be able to jettison cargo, transfer cargo to other tanks or to other vessels or shore facilities.

These and other novel features and advantages of the invention will be described in greater detail in the following detailed description.

BRIEF DESCRIPTION OF THE DRAWINGS

In the drawings, wherein similar reference numerals denote similar elements throughout the several views thereof;

FIG. 3 is a transverse cross-sectional view of the vessel taken along Section 3—3 of FIG. 1; and FIG. 4 is another transverse cross-sectional view of the tanker vessel illustrating bottom and side hull ruptures caused by grounding and side damage thereto.

DETAILED DESCRIPTION

Figure 1:
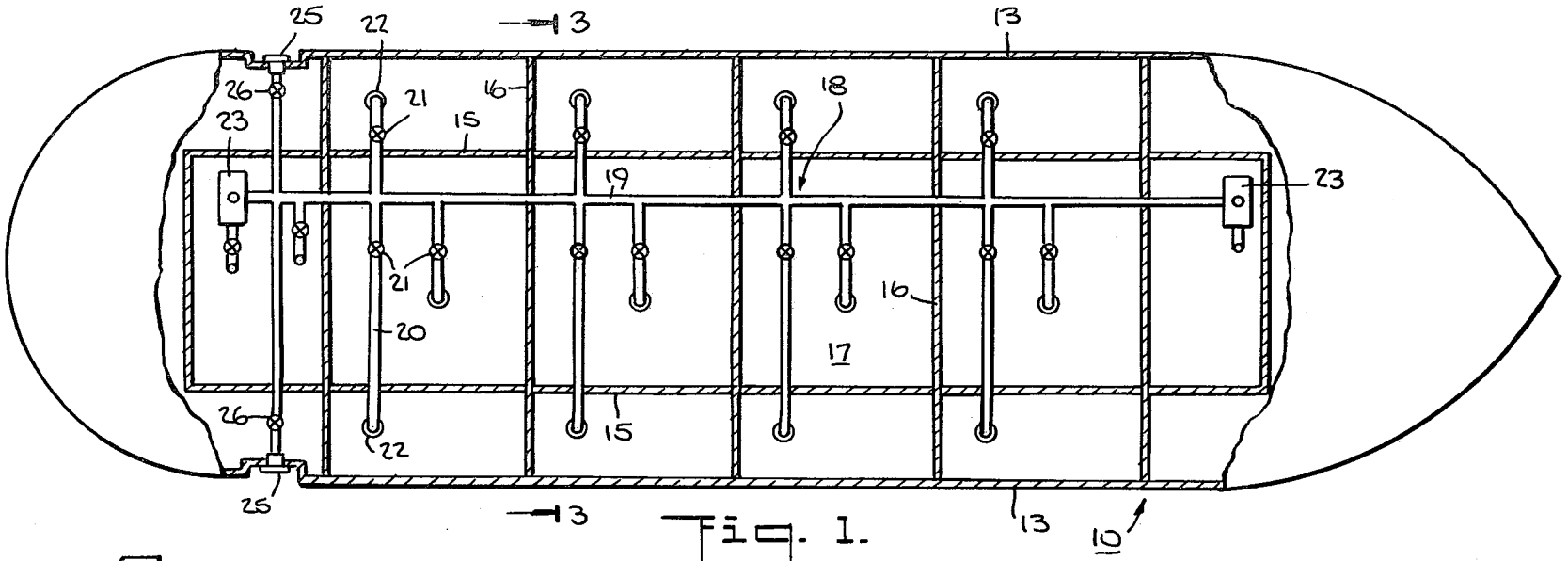
FIG. 1 is a longitudinal, top plan view, partly in cross-section, of a tanker vessel including a cargo handling system constructed according to the present invention.
Figure 2:
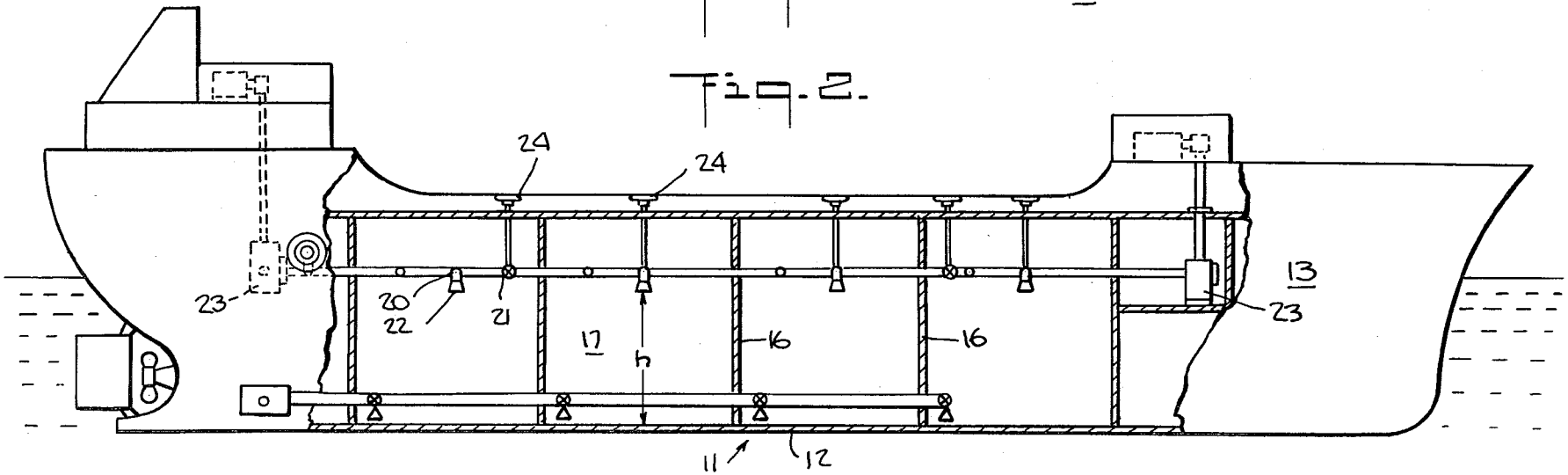
FIG. 2 is a side view, also partly in cross-section, of the tanker vessel illustrated in FIG. 1.

Referring now to the drawings, there is shown a tanker vessel 10 which includes a hull 11 comprising a bottom 12 and sides 13. The vessel also includes a top deck 14 and a plurality of longitudinal and transverse bulkheads 15 and 16, respectively, which are disposed within the hull of the vessel and form a plurality of watertight cargo compartments 17 between top deck 14 and hull bottom 12 for storing liquid cargo. The vessel further includes a main liquid cargo charging and discharging system (not shown) comprising a longitudinally disposed main pipe, suitable pump means, such as a motor-driven pump, coupled to the pipe, and transverse branch lines coupled to the pipe and opening into each of the cargo compartments 17 and disposed in the vessel adjacent hull bottom 12 for charging and discharging cargo stored in cargo compartments 17. An additional liquid charging and discharging system 18 comprising longitudinal pipe 19 and transverse branch lines 20 coupled to pipe 19, is included in the vessel. Each of the branch lines includes a valve 21 for controlling the charging and discharging of each of the cargo compartments, and a suction opening 22 disposed in and opening into cargo compartments 17 at a vertical distance h above the hull bottom 12 of the vessel which is less than the neutral pressure height in the cargo compartments when the tanker's bottom is damaged, specifically at a distance above the hull bottom 12 which is approximately equal to $H(S_w/S_c)$—0.10H, where H represents the distance from hull bottom 12 to the vessel's waterline, i.e., the vessel draught, $S_w$ represents the specific gravity of sea water, and $S_c$ represents the specific gravity of the heaviest cargo which the vessel is adapted to carry. The location of suction opening 22 below the neutral pressure height, specifically, at the distance h above the bottom 12 of the vessel, allows for variations in the specific gravities in the cargo and sea water and due to the changes in temperature and vessel trim.

It should be noted that the term "waterline" as used herein refers to the load line of the vessel which is to be used during its operation, for example, the vessel's summer draught, and that as known to those persons skilled in the art, the location of the waterline may vary slightly with respect to its height above the vessel's hull bottom according to the load line utilized.

The additional liquid cargo charging and discharging system 18 is redundant and as already described, is provided in addition to the main charging and discharging system of vessel 10. This additional charging and discharging system preferably includes a motor-driven pump 23 which is located at the aft end of the vessel and is coupled to main pipe 19. The vessel may also have another pump 23 located in the fore end of the vessel. Both pumps 23, as well as main pipe 19 and branch lines 20, are located at approximately the waterline of the vessel. This reduces suction-life problems associated with pumping cargo from cargo compartments 17. Also, locating pumps 23 at both the fore and aft ends of the vessel permits discharging of the compartments in the event one end of the vessel is rendered inoperable due to fire, explosion, collision or flooding. Pumps 23 may each comprise a centrifugal type pump or a positive displacement type pump and may be driven by the tanker vessel's emergency diesel generator output, or direct motor drive. The valves 21 coupled to branch lines 20 of the cargo handling system 18 are controlled by handwheels 24 whose shafts extend vertically downward from top deck 14 of the vessel to the valves. The suction openings 22 are preferably located either at the aft end or the forward end of each of the cargo compartments 17. System 18 is preferably interconnected with the main charging and discharging system of the vessel. In such an embodiment, the forward pump 23 of the vessel may be connected to the forward bunker line thereof, which normally has several deck manifolds including a set adjacent to the vessel's cargo manifold. It should be noted that the system may also be used without pumps 23 and may instead utilize the main cargo pumps only.

The vessel also preferably includes a recessed coupling 25 located on one or both sides of the vessel slightly above the vessel's load line which is coupled to pipe 19 for emergency cargo discharge, or to take suction for off-loading another vessel in distress. The coupling is adapted for connection to pipe means external to the vessel for receiving or discharging liquid cargo and may also be connected to the main charging and discharging system of the vessel. The coupling considerably reduces typical cargo pumping suction-lift problems, since suction will be available with tanks open to the sea, and the level of cargo in the compartments, when full, will be higher than the salvage connection. This enables priming of the lines and pumps of the system 18, and should facilitate transfer of cargo from one vessel to another in salvage operations. The coupling is connected to a double valved salvage coupling line which preferably includes a standard cast steel glove valve 26 for positive control during normal charging and discharging of cargo.

FIGS. 3 and 4 illustrate the operation of the invention upon the occurrence of damage to hull bottom 12 caused by hull bottom rupture 27 and side hull rupture 28 resulting from docking, barge, tug or similar damage. In the case of rupture 27, valve 21 of the affected compartment is opened and although most of the pressure head of cargo will be lost, a portion of the fluid pressure head of the liquid cargo in the compartments may be transferred from the compartments by system 18 through suction openings 22. The remaining liquid cargo in the cargo compartment has a specific gravity which is less than that of sea water, and will basically remain there for an indefinite period of time. In the case of side hull rupture 28, a larger amount of cargo, illustrated by reference numeral 29 is lost, namely that portion of the cargo which extends up to the height of rupture 28 in the hull. Some of the liquid cargo which otherwise would be lost, may be transferred from the affected cargo tank to another cargo tank of the vessel by means of this additional liquid cargo charging and discharging means.

In summary, the loss of some vessels and/or cargoes can be avoided by using the liquid cargo handling system of the present invetion. In all bottom damage situations, such systems provide flexibility and assistance for removing cargo by the vessel's crew or by salvage operations, even though the vessel's main charging and discharging system is rendered inoperable. Considerable pollution and cargo loss may be avoided thereby.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a tanker vessel for carrying a plurality of liquid cargoes each having a specific gravity which is less than that of sea water, said vessel including a hull comprising a bottom and sides, a top deck, at least one cargo compartment disposed between said top deck and said hull bottom for storing said liquid cargo, and main liquid cargo charging and discharging means coupled to said cargo compartment for charging and discharging said compartment, the improvement comprising additional liquid cargo charging and discharging means coupled to said cargo compartment, said additional liquid cargo charging and discharging means including pipe means longitudinally disposed in said vessel, transversely disposed valved branch line means coupled to said pipe means, said branch line means including a suction opening disposed in and opening into said cargo compartment at a distance above said hull bottom which is approximately equal to $H(S_w/S_c)-0.10H$, where H represents the distance from the bottom of said vessel to its waterline, $S_w$ represents the specific gravity of sea water, and $S_c$ represents the specific gravity of the heaviest liquid cargo which said vessel is adapted to carry.

2. The improvement recited in claim 1, wherein said pipe means and said branch line means are disposed at approximately the waterline of said vessel.

3. The improvement recited in claim 2, wherein said additional charging and discharging means includes motor-driven pump means coupled to said pipe means, said pump means being located at approximately the waterline of said vessel.

4. The improvement receited in claim 3, wherein said pump means comprises a first pump located at the rearward end of said vessel.

5. The improvement recited in claim 4, wherein said pump means further comprises a second pump located at the forward end of said vessel.

6. The improvement recited in claim 3, wherein said main liquid cargo charging and discharging means is coupled to said additional liquid cargo charging and discharging means.

7. The improvement recited in claim 3, further comprising coupling means, disposed in at least one of said sides of said hull and coupled to said pipe means, said coupling means being recessed with respect to said one of said sides of said hull and being adapted for connection to pipe means external to said vessel, said coupling means further being located adjacent and above the load line of said vessel.

8. The improvement recited in claim 7, wherein said vessel includes a plurality of longitudinally and transversely disposed vertical bulkheads disposed in said vessel between said hull bottom and said top deck, said bulkheads forming a plurality of watertight liquid cargo compartments for storing said cargo, said additional liquid cargo charging and discharging means including a plurality of said branch line means coupled to and opening into each of said cargo compartments.

* * * * *

UNITED STATES PATENT AND TRADEMARK OFFICE

CERTIFICATE OF CORRECTION

PATENT NO. : 4,389,959

DATED : June 28, 1983

INVENTOR(S) : Charles S. Conway

It is certified that error appears in the above—identified patent and that said Letters Patent is hereby corrected as shown below:

Column 4, line 13, after "suction-", delete "life" and substitute -- lift --.

Column 4, line 54, delete "glove" and substitute -- globe --.

Column 6, line 16, delete "receited" and substitute -- recited --.

Signed and Sealed this

*Seventeenth* Day of *January 1984*

[SEAL]

*Attest:*

GERALD J. MOSSINGHOFF

*Attesting Officer*

*Commissioner of Patents and Trademarks*